US006165046A

United States Patent [19]

Boser

[11] Patent Number: 6,165,046

[45] Date of Patent: Dec. 26, 2000

[54] DUAL FOLDING TOOL AND METHOD OF USE

[76] Inventor: Ronald Boser, 3051 Industrial 25$^{th}$St., Ft. Pierce, Fla. 34946

[21] Appl. No.: 09/511,254

[22] Filed: Feb. 23, 2000

[51] Int. Cl.$^{7}$ ..... A41C 1/14; D05B 35/00; D05B 35/10

[52] U.S. Cl. ..... 450/41; 450/45; 112/136; 112/139; 112/152

[58] Field of Search ..... 450/41, 45, 46, 450/47, 48, 49, 51, 52, 53; 112/136, 139, 152

[56] References Cited

U.S. PATENT DOCUMENTS

| | | | |
|---|---|---|---|
| 2,480,049 | 8/1949 | Rosenberg | 450/41 |
| 2,528,105 | 10/1950 | Alberts | 450/41 |
| 4,203,449 | 5/1980 | Winzelberg | 450/41 |

*Primary Examiner*—Gloria M. Hale

[57] ABSTRACT

The use of a left and right-turning folding tool in the sewing of underwires providing support for a brassiere left and right cup, in which the starting end of the underwires are alternately sewn starting in the middle of the brassiere, i.e. at the location of the user's cleavage, so that by visual observation, the underwire starting ends are sewn at the same height to contribute to a neat appearance in this critical observed location of the brassiere.

1 Claim, 3 Drawing Sheets

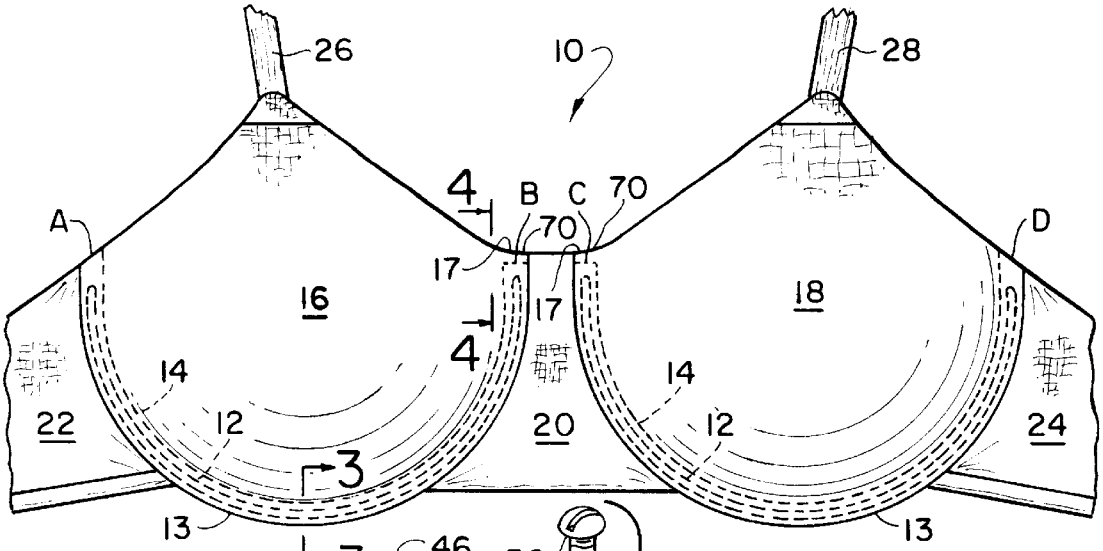
FIG.1
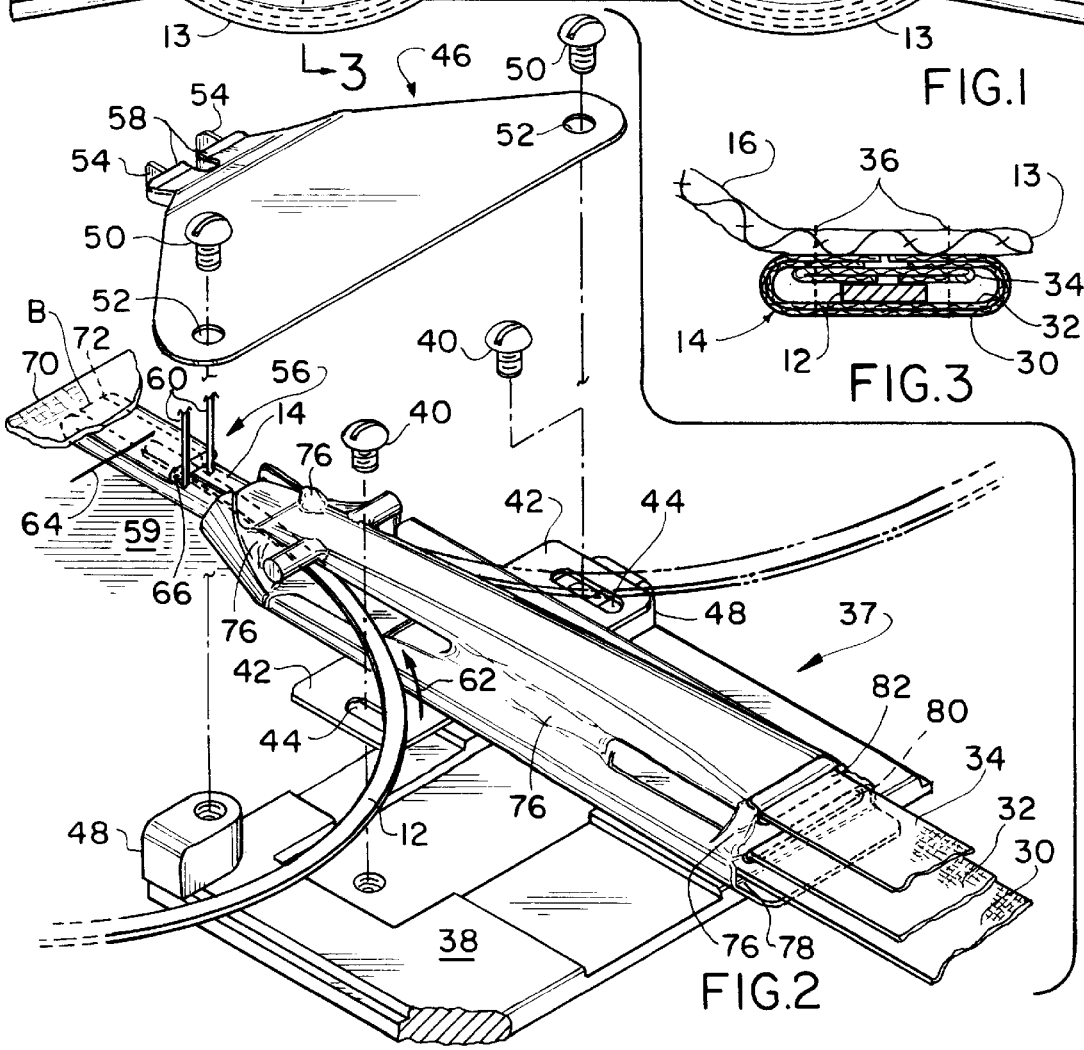
FIG.2
FIG.3

DUAL FOLDING TOOL AND METHOD OF USE

The present invention relates generally to an improved brassiere in which construction aspects are correlated to breast anatomical aspects to contribute to enhancing comfort and uplifting support during wearing of the brassiere, and more particularly to improvements in providing the noted constructional aspects, i.e., breast cup-shaping underwires, consistent with maintaining a significantly desirable neat appearance in the brassiere.

Example of the Prior Art

As known from common experience and for obvious reasons, the bottom of a brassiere cup is typically of a U and/or semi-circular shape to thusly conform in shape to the bottom shape of a breast. In the U and/or semi-circular brassiere cup shape it is known to use a shape-conforming component, usually of wire construction material and known in trade parlance as an "underwire". Exemplary of prior art patents disclosing and illustrating a brassiere cup underwire is U.S. Pat. No. 4,203,449 for "Stretchable Underwire Casing For Breast Pockets" issued to Leo L. Winzelberg on May 20, 1980.

In the '449 and all other known patents there is the conformance in shape noted between the bottoms of the brassiere cup embodied with an underwire and breast, but not always is the provision of the underwire achieved without detracting from the appearance of the brassiere. More particularly, from a fashion viewpoint the cleavage area, i.e., the area between and immediate adjacent the centrally located underwires is the focus of a viewer's attention and that an inadvertent poking of an underwire in its binding beyond a top edge of the cups significantly mars the appearance of the brassiere.

Broadly, it is an object of the present invention to construct a brassiere overcoming the foregoing and other shortcomings of the prior art.

More particularly, it is an object in the sewing of binding-encased underwires in place in supporting and shaping relation to the breasts to make advantageous use of left and right-turning folding tools not only for proper tracking of the underwires to their respective sites of sewing attachment, but also using the noted left and right-turning folding tools in a unitary construction, the latter being a happenstance that obviates the inadvertent readily observable appearance-marring position of an encased underwire, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit ol the appended claims.

FIG. 1 is a front elevational view as seen by an observer of a brassiere with sewing details according to the present invention;

FIG. 2 is a perspective view of right and left-turning underwire guiding means in a unitary construction according to the present invention;

FIG. 3 is a cross-sectional view taken along line 3—3 of FIG. 1.

Figure 10:
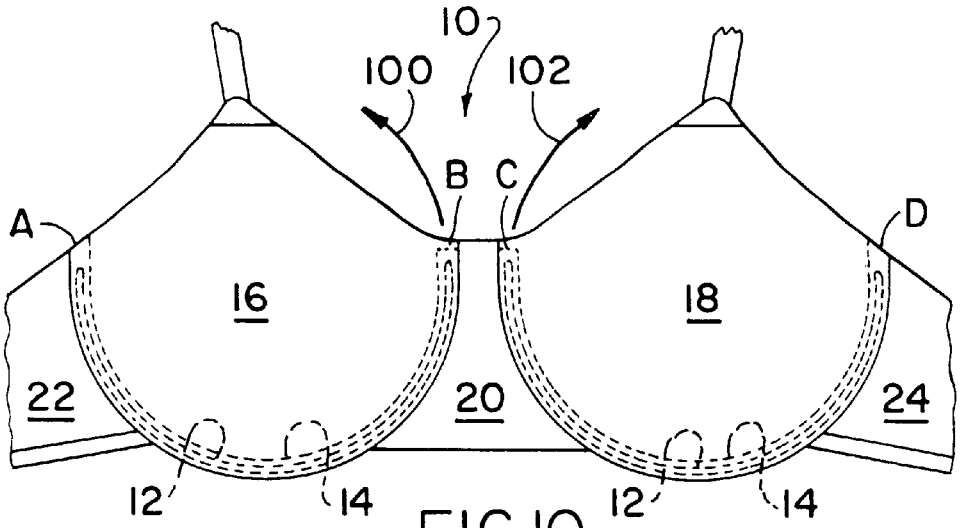
FIG. 10 is a schematic view of a completed bra showing the left and right side paths of underwire and binding as they pass through the sewing station.

With reference to a brassiere, generally designated 10 in FIGS. 1 and 10, it will be understood to be of the type having sewn in place underwires 12 along lower peripheral edges 13 of breast-supporting right and left cups 16 and 18. As will be explained in detail in the description which follows, underlying the patentable advance of the brassiere 10 is the recognition that from a fashion viewpoint the cleavage area, i.e. the area between and immediate adjacent the reference locations B and C of FIG. 1, is the focus of a viewer's attention and that an inadvertent poking of an underwire 12 beyond a top edge 17 of the cups 16 and 18 significantly mars the appearance. The avoidance of an attached binding enclosed underwire construction 12 that can be observed extending beyond a cup top edge 17 is now described.

As already noted, in FIG. 1 it is shown that a conventional brassiere or bra 10 has been fitted with underwires 12 that have been sewn in place within a binding assembly 14.

Bra 10 is made up of a right breast cup 16 and a left breast cup 18, both sewn to a connecting panel 20. Right and left girth panels, 22, 24 respectively complete the bra 10 except for support straps 26, 28 which obviously may be absent in the case of a strapless bra.

FIG. 3 shows a typical cross section of the binding assembly 14 enfolding underwire 12. Binding 14 consists of an outside tape 30, a middle tape 32 and an inside tape 34 in folded configuration about underwire 12 and stitched to right breast cup 16 (or left breast cup 18) as at 36. Fabric tapes 30, 32 and 34 are of appropriate width and suitable texture.

Industry standards allow for a variety of binding configurations and the preferred embodiment shown is of the type made of the tape folder 37 shown in FIGS. 2, 5–9. Folder 37 is normally attached to a mounting plate 38 by screws 40 which connect rectangular bracket 42 to plate 38 via elongated holes 44. In turn, a spring guide plate 46 is attached to stanchions 48 on plate 38 by screws 50 via holes 52. In use, spring guide plate 46 has vertical walls 54 which guide tape assembly 14 directly towards sewing station 56. Horizontal projection 58 directs a small spring force vertically downward along the top face of the binding 14 as it exits folder 36 in the immediate vicinity of station 56.

Sewing station 56 is part of a conventional computerized industry type double needle sewing machine 59 which has been fitted out for the underwire operation. Machine 59 has needles 60, a special foot (not shown) and a special feed dog (not shown). The foot and feed dog operate in the usual manner to draw binding 14 from folder 36 through sewing station 56.

FIG. 2 depicts the static moment of the sewing cycle when the needles 60 and foot (not shown) are down and underwire 12 for the right breast cup 16 has just been inserted into position within binding 14 and between needles 60, for the cycle to continue. Underwire 12 is pushed by the operator in the direction of arrow 62 against an automatic stop 64

Figure 4:
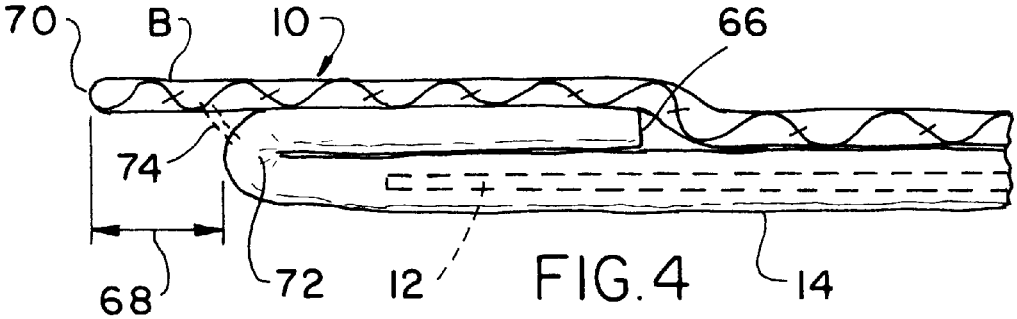
FIG. 4 is a cross-sectional view as taken along line 4—4 of FIG. 1.

(represented by line 64). The leading end 66 of binding 14 (sheared in the previous operation) has been folded over (See FIG. 4) by mechanism not shown and automatically stitched to bra 10. Before stitching at area B on bra 10, the operator insures that a distance 68 has been set between the top edge 70 and the binding fold 72. The distance 68, preferably ¼ inch, allows for binding 14 to remain hidden in the cleavage area of the wearer.

Figure 5:
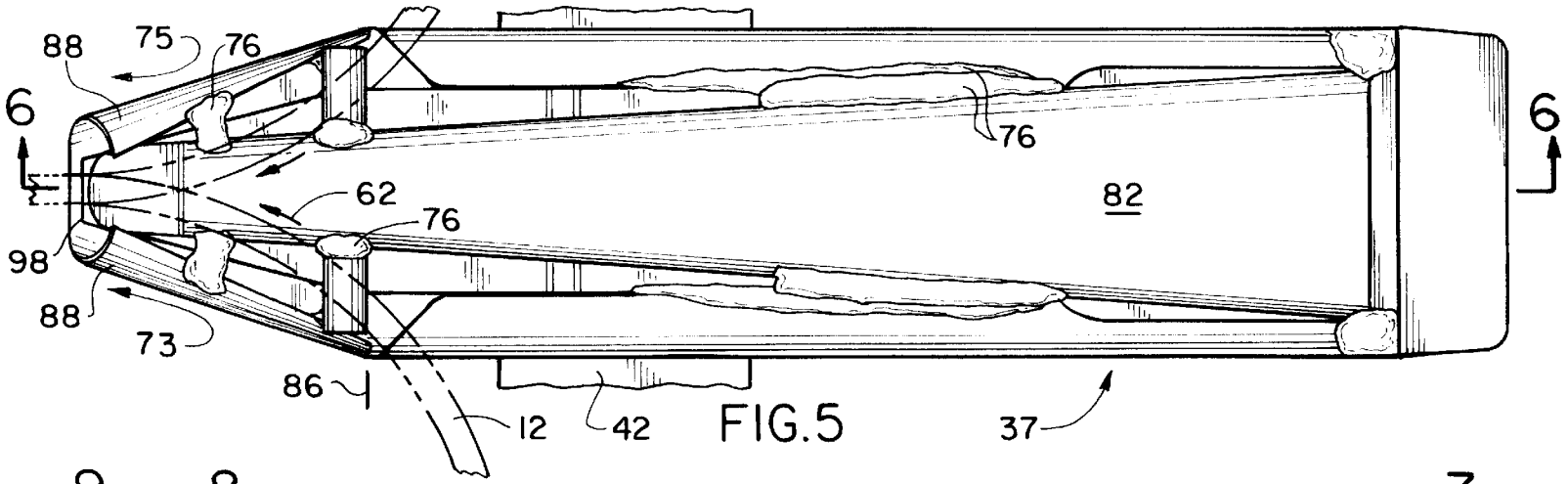
FIG. 5 is a plan view, on an enlarged scale, of the unitary underwire-guarding.

As background for the detailed description of the sewing attachment of the underwires 12 which follows, it is helpful in understanding the patentable advance to understand the functional contribution of the unitary construction of FIG. 5 characterized by a left 73 and right 75 turning underwire guiding means or tool. If as is currently the practice use is made only of a left turning tool-this would require sewing of the right breast cup 16 from the inboard location B to the outboard location A, and on the left breast cup 18 from the outboard location D to the inboard location C, at which location C an end of the underwire 12 could inadvertently be allowed by sewing that is properly terminated to poke through the top edge 17 of the right cup 18. The clearance 68 of at least ¼ inch provides a necessary margin of error.

For completeness sake, it is also to be understood that the use of only the right turning tool 75 requires sewing of the right cup 18 from the inboard location C to the outboard location D and on the left cup 16 from the outboard location A to the inboard location B, described consequence could occur to mar the wearing appearance of the brassiere 10, but is significantly lessened by the margin of error spacing 68.

Once the bra 10 has been set relative to fold 72 the foot (not shown) is lowered and the machine 59 automatically carries out the back tack 74 operation and sews forward to the position shown in FIG. 2. At this point in the cycle wire 12 is made ready and manually inserted through folder 36 into binding 14 between Needles 60.

Folder 36 is made of fabricated sheet metal components which are soldered together as at 76. Folder 36 consists basically of mounting bracket 42 and three conduits 78, 80 and 82. For sake of simplicity in FIGS. 6–9 tape 30 is shown as a single dot line, tape 32 is shown as a double dot line and tape 34 is shown as a triple dot line. As tape 30 is drawn through conduit 78 it remains flat and is joined by tape 32 which descends from conduit 80 as it ends at 84. Combined tapes 30, 32 continue along lower conduit 78 to point 86 where the outer edges of tapes 30, 32 are curled upward and then inwardly by curved walls 88 about wire 12 and formed tape 34. Simultaneously, with tapes 30, 32, tape 34 is drawn through upper conduit 82 where it starts flat at folder inlet end 90. As tape 34 advances through conduit 82 its outer edges are turned downward as at 92 and then folded under as at FIG. 8.

Figure 6:
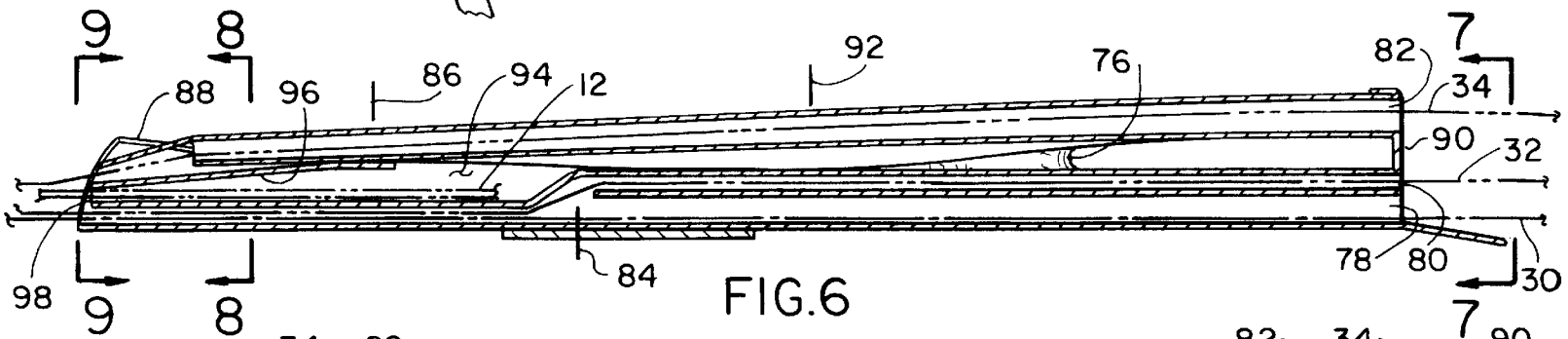
FIG. 6 is a cross-sectional view as taken along line 6—6 of FIG. 5.
Figure 7:
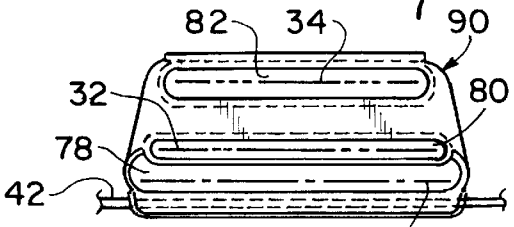
FIG. 7 is an end view as seen in the direction of line 7—7 of FIG. 6.
Figure 8:
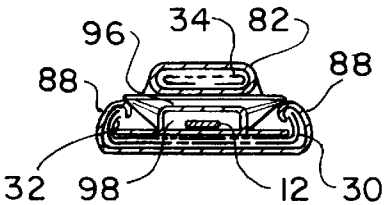
FIG. 8 is a cross-sectional view as taken along line 8—8 of FIG. 6.
Figure 9:
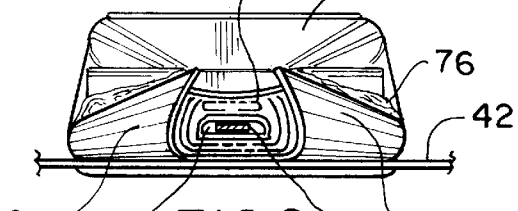
FIG. 9 is an end view as seen in the direction line 9—9 of FIG. 6.

In FIG. 6, immediately downstream, after the end of conduit 80 as at 84 a vertical space 94 is available for the insertion of wire 12 from either side of folder 36 and between points 84 and 86. During insertion the leading end of wire 12 is guided by a plate 96 which tapers into an aperture 98.

After the right breast cup wire 12 has been inserted the operator starts the machine and guides the bra 10 through sewing station 56 as binding 14 continues to merge from folder 36 under spring guide plate 46 and vertical walls 58.

Referring to FIG. 10 it is seen that as point B passes the sewing station 56 point B turns to the left in a counterclockwise circular path as at arrow 100. As the operator continues sewing point A approaches the sewing station 56 where the binding shear (not shown) cuts binding 14 after a negligible bit of overrun past point A. When the stitching is stopped at point A the operator activates the binding shear (not shown) as previously mentioned which in turn, activates the mechanism (not shown) that folds the binding 14 (FIG. 4), with needles 60 and foot in the up position awaiting the placement of point C of bra 10 in the sewing station 56 for the sewing of left cup wire 12.

Those skilled in the art will recognize that the sewing of the left breast cup wire 12 is identical to that of the right cup wire except that the leading end of wire 12 is inserted from the operator's right side of folder 36 and that (FIG. 10) sewing takes place from point C to point D. As sewing progresses point C will move in a clockwise direction along a path as indicated by arrow 102 until point D passes through sewing station 56 where binding 14 is sheared. This starts the folding of binding 14 referred to previously (FIG. 4) ready for the sewing, of the right breast cup 16 on the next bra 10.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A brassiere of a type having binding-encased underwires sewn in place along lower peripheral arcuate edges of breast-supporting cups, said brassiere comprising a right breast-supporting cup having a top edge and a length portion in clockwise curvature extending therefrom in adjacent relation to a left side of a cleavage area of a user to a selected first operative site, a right breast-supporting cup having a top edge and a length portion in counterclockwise curvature extending therefrom in adjacent relation to a right side of a cleavage area of a user to a selected second operative site, a unitary structure of attaching said underwires to said left and right cups characterized by a left and right-turning underwire guiding tool, and operative movements of said right cup underwire through said left turning tool from said selected first operative site and of said left cup underwire through said right turning tool from said selected second operative site, said first and second operative sites selected to be at least ¼ inch from the respective top edges of said left and right cups, whereby there is clearance of at least ¼ inch of said sewn in place underwires below said left and right cup top edges to obviate any underwire projection through said top edges as might mar a desirable appearance of the cleavage of a user during the wearing of the brassiere.

* * * * *